US010718094B1

(12) United States Patent
Nelson

(10) Patent No.: US 10,718,094 B1
(45) Date of Patent: Jul. 21, 2020

(54) TUB GIRDERS AND RELATED MANUFACTURING METHODS

(71) Applicant: Valmont Industries, Inc., Omaha, NE (US)

(72) Inventor: Guy C. Nelson, Byron Center, MI (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 16/273,928

(22) Filed: Feb. 12, 2019

(51) Int. Cl.

| | |
|---|---|
| ***E01D 1/00*** | (2006.01) |
| ***E01D 2/04*** | (2006.01) |
| ***E04C 3/294*** | (2006.01) |
| *E04C 3/04* | (2006.01) |
| *E01D 101/26* | (2006.01) |

(52) U.S. Cl.
CPC ..... *E01D 2/04* (2013.01); *E01D 1/00* (2013.01); *E04C 3/294* (2013.01); *E01D 2101/268* (2013.01); *E04C 2003/0473* (2013.01)

(58) Field of Classification Search
CPC ..... E01D 1/00; E01D 2/04; E01D 2101/268; E04C 3/294; E04C 2003/0473
USPC ..... 14/74.5; 52/831
See application file for complete search history.

(56) References Cited

U.S. PATENT DOCUMENTS

| | | | | |
|---|---|---|---|---|
| 2,373,072 | A | 8/1941 | Wichert | |
| 3,812,636 | A * | 5/1974 | Albrecht | E04B 5/40 52/334 |
| 4,129,917 | A * | 12/1978 | Sivachenko | E01D 2/04 14/6 |
| 4,493,177 | A | 1/1985 | Grossman | |
| 5,471,694 | A | 12/1995 | Meheen | |
| 6,081,955 | A * | 7/2000 | Dumlao | B63B 5/24 14/73 |
| 7,600,283 | B2 | 10/2009 | Nelson | |
| 7,627,921 | B2 | 12/2009 | Azizinamini | |
| 9,915,045 | B1 * | 3/2018 | Azizinamini | E01D 2/00 |
| 10,161,090 | B2 | 12/2018 | Lee et al. | |
| 2018/0135261 | A1 | 5/2018 | Nelson | |

* cited by examiner

*Primary Examiner* — Raymond W Addie
(74) *Attorney, Agent, or Firm* — Quisenberry Law PLLC

(57) ABSTRACT

A tub girder for use in road construction in connection with concrete bridges may include upper flanges that extend inwardly or outwardly and may be provided with camber along the length of the girders. Ends of the tub girders may be provided with diaphragms and may include a base section including one more access ports for enabling inspection of the interior of the girders after installation. The tub girders may include a plurality of stud members extending upwardly from upper flanges for engaging with a concrete bridge deck. The tub girders may be provided with a coating, such as galvanized, aluminized or metalized, to fight corrosion and extend life and limit need for inspection.

20 Claims, 15 Drawing Sheets

TUB GIRDERS AND RELATED MANUFACTURING METHODS

BACKGROUND OF THE INVENTION

1. Field of the Invention

The present inventions generally pertain to construction materials and related manufacturing methods, and more particularly to improved tub girders for use in the construction industry, including in the road construction industry in connection with construction of concrete bridges.

2. Description of the Related Art

It is known to use steel beams in a variety of shapes and sizes in the construction industry to erect many types of structures, including in the road construction industry. For example, one well known beam shape in the construction industry is an I-beam, such as disclosed in U.S. Pat. No. 4,493,177 to Grossman and U.S. Pat. No. 2,373,072 to Wichert. Other examples of beams that have been used in the construction industry, such as in the road construction industry in connection with the construction of concrete bridges, include what are known as box girders and tub girders. Representative examples of these types of box girders or tub girders are shown for example in U.S. Pat. No. 7,627,921 to Azizinamini and U.S. Pat. No. 7,600,283 to Nelson.

As will become apparent from the following descriptions and discussion, the present inventions employ the use of a press brake to form tub girders in the particular configurations disclosed and claimed herein, and also introduce camber to tub girders through permanent steel deformation in novel ways to achieve improved tub girders. The present inventions also include related manufacturing methods in comparison to those disclosed in the above-listed disclosures.

SUMMARY OF THE INVENTIONS

Improved tub girders and related manufacturing methods are disclosed. In one aspect, a specific embodiment of the present inventions may be an improved tub girder having a body member having a girder length, comprising: a base having a central axis that bisects and is disposed in a generally perpendicular relationship to the base; an outwardly inclining left support member extending upwardly away from a left end of the base at a first angle and also away from the central axis, a transition from the left end of the base to the outwardly inclining left support member being defined by a first radius, the first angle being in the range from 90 to 104 degrees; an outwardly inclining right support member extending upwardly away from a right end of the base at a second angle and also away from the central axis, a transition from the right end of the base to the outwardly inclining right support member being defined by a second radius, the second angle being in the range from 90 to 104 degrees; a left flange extending inwardly toward the central axis from an upper end of the outwardly inclining left support member at a third angle in relation to the outwardly inclining left support member, the left flange being disposed in generally parallel relationship to the base and spaced apart from the base by a height distance, a transition from the upper end of the outwardly inclining left support member to the left flange being defined by a third radius, the left flange having an inner end, the left flange having a left flange width equal to the distance from the inner end of the left flange to a center of the third radius, the third angle being in the range from 76 to 90 degrees; a right flange extending inwardly toward the central axis from an upper end of the outwardly inclining right support member at a fourth angle in relation to the outwardly inclining right support member, the right flange being disposed in generally parallel relationship to the base and spaced apart from the base by the height distance, a transition from the upper end of the outwardly inclining right support member to the right flange being defined by a fourth radius, the right flange having an inner end, the right flange having a right flange width equal to the distance from the inner end of the right flange to a center of the fourth radius, the fourth angle being in the range from 76 to 90 degrees; the inner end of the left flange being spaced apart from the inner end of the right flange by an open width distance, a ratio of the open width distance to the height distance being in the range from 0.85 to 3.0; the base, outwardly inclining left support member, outwardly inclining right support member, left flange and right flange having a common thickness, a ratio of the left flange width to the common thickness being no greater than 16, a ratio of the right flange width to the common thickness being no greater than 16; each of the first radius, the second radius, the third radius and the fourth radius being at least five times greater than the common thickness; and the base having a base width equal to the distance from a center of the first radius to a center of the second radius, a ratio of the base width to the height distance being at least greater than 0.8, and a ratio of the base width to the common thickness being no greater than 100.

Another feature of this aspect of the present inventions may be that each of the first radius, the second radius, the third radius and the fourth radius may be in the range from 1½ to 2½ inches. Another feature of this aspect of the present inventions may be that the open width distance may be approximately thirty inches. Another feature of this aspect of the present inventions may be that the girder length may be in the range from 20 to 100 feet. Another feature of this aspect of the present inventions may be that the body member may be formed from a single rectangular sheet of material through the use of at least one of a press brake, hot rolling and roll forming. Another feature of this aspect of the present inventions may be that the body member may be permanently, mechanically deformed to include camber along its girder length. Another feature of this aspect of the present inventions may be that the body member may include at least one of a galvanized coating, an aluminized coating and a metalized coating.

In another aspect, a specific embodiment of the present inventions may be an improved tub girder having a body member having a girder length, comprising: a base having a central axis that bisects and is disposed in a generally perpendicular relationship to the base: an outwardly inclining left support member extending upwardly away from a left end of the base at a first angle and also away from the central axis, a transition from the left end of the base to the outwardly inclining left support member being defined by a first radius, the first angle being in the range from 90 to 104 degrees; an outwardly inclining right support member extending upwardly away from a right end of the base at a second angle and also away from the central axis, a transition from the right end of the base to the outwardly inclining right support member being defined by a second radius, the second angle being in the range from 90 to 104 degrees; a left flange extending outwardly away from the central axis from an upper end of the outwardly inclining left support member at a third angle in relation to the outwardly inclining left support member, the left flange being disposed in generally parallel relationship to the base and spaced apart from the base by a height distance, a transition from the upper end of the outwardly inclining left support member to the left flange being defined by a third radius, the left flange having an outer end, the left flange having a left flange width equal to the distance from the outer end of the left flange to a center of the third radius, the third angle being in the range from 90 to 104 degrees; a right flange extending outwardly away from the central axis from an upper end of the outwardly inclining right support member at a fourth angle in relation to the outwardly inclining right support member, the right flange being disposed in generally parallel relationship to the base and spaced apart from the base by the height distance, a transition from the upper end of the outwardly inclining right support member to the right flange being defined by a fourth radius, the right flange having an outer end, the right flange having a right flange width equal to the distance from the outer end of the right flange to a center of the fourth radius, the fourth angle being in the range from 90 to 104 degrees; the left flange being spaced apart from the right flange by an open width distance defined by the distance from the center of the third radius to the center of the fourth radius, a ratio of the open width distance to the height distance being in the range from 1.1 to 4.0; the base, outwardly inclining left support member, outwardly inclining right support member, left flange and right flange having a common thickness, a ratio of the left flange width to the common thickness being no greater than 16, a ratio of the right flange width to the common thickness being no greater than 16; each of the first radius, the second radius, the third radius and the fourth radius being at least five times greater than the common thickness; and the base having a base width equal to the distance from a center of the first radius to a center of the second radius, a ratio of the base width to the height distance being at least greater than 0.5, and a ratio of the base width to the common thickness being no greater than 75.

Another feature of this aspect of the present inventions may be that each of the first radius, the second radius, the third radius and the fourth radius may be in the range from 1½ to 2½ inches. Another feature of this aspect of the present inventions may be that the open width distance may be approximately forty inches. Another feature of this aspect of the present inventions may be that the girder length may be in the range from 20 to 100 feet. Another feature of this aspect of the present inventions may be that the body member may be formed from a single rectangular sheet of material through the use of at least one of a press brake, hot rolling and roll forming. Another feature of this aspect of the present inventions may be that the body member may be permanently, mechanically deformed to include camber along its girder length. Another feature of this aspect of the present inventions may be that the body member may include at least one of a galvanized coating, an aluminized coating and a metalized coating.

In yet another aspect, a specific embodiment of the present inventions may be an improved tub girder having a body member having a girder length, comprising: a base having a central axis that bisects and is disposed in a generally perpendicular relationship to the base; an outwardly inclining left support member extending upwardly away from a left end of the base at a first angle and also away from the central axis, a transition from the left end of the base to the outwardly inclining left support member being defined by a first radius, the first angle being in the range from 90 to 104 degrees; an outwardly inclining right support member extending upwardly away from a right end of the base at a second angle and also away from the central axis, a transition from the right end of the base to the outwardly inclining right support member being defined by a second radius, the second angle being in the range from 90 to 104 degrees; a left flange extending from an upper end of the outwardly inclining left support member at a third angle in relation to the outwardly inclining left support member, the left flange being disposed in generally parallel relationship to the base and spaced apart from the base by a height distance, a transition from the upper end of the outwardly inclining left support member to the left flange being defined by a third radius, the left flange having an inner end and an outer end, the left flange having a left flange width, the third angle being in the range from 76 to 104 degrees; a right flange extending from an upper end of the outwardly inclining right support member at a fourth angle in relation to the outwardly inclining right support member, the right flange being disposed in generally parallel relationship to the base and spaced apart from the base by the height distance, a transition from the upper end of the outwardly inclining right support member to the right flange being defined by a fourth radius, the right flange having an inner end and an outer end, the right flange having a right flange width, the fourth angle being in the range from 90 to 104 degrees; the left flange being spaced apart from the right flange by an open width distance, a ratio of the open width distance to the height distance being in the range from 0.85 to 4.0; the base, outwardly inclining left support member, outwardly inclining right support member, left flange and right flange having a common thickness, a ratio of the left flange width to the common thickness being no greater than 16, a ratio of the right flange width to the common thickness being no greater than 16; each of the first radius, the second radius, the third radius and the fourth radius being at least five times greater than the common thickness; and the base having a base width equal to the distance from a center of the first radius to a center of the second radius, a ratio of the base width to the height distance being at least greater than 0.5, and a ratio of the base width to the common thickness being no greater than 100.

Another feature of this aspect of the present inventions may be that each of the left flange and the right flange may extend inwardly toward the central axis. Another feature of this aspect of the present inventions may be that each of the left flange and the right flange may extend outwardly away from the central axis. Another feature of this aspect of the present inventions may be that the body member may be formed from a single rectangular sheet of material through the use of at least one of a press brake, hot rolling and roll forming. Another feature of this aspect of the present inventions may be that the body member may be permanently, mechanically deformed to include camber along its girder length. Another feature of this aspect of the present inventions may be that the body member may include at least one of a galvanized coating, an aluminized coating and a metalized coating.

Other features, aspects and advantages of the present inventions will become apparent from the following discussion and detailed description.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTIONS

Figure 1:
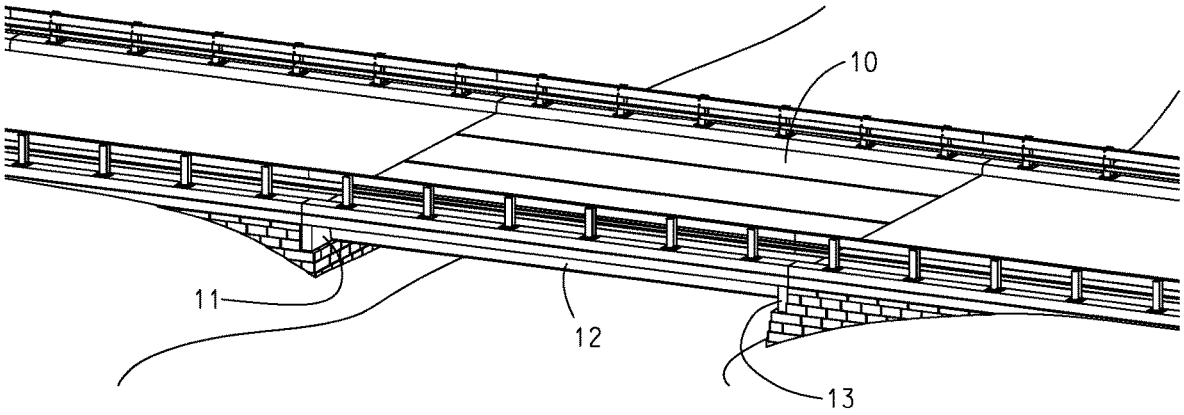
FIG. 1 is a perspective view of a bridge structure constructed using improved tub girders and in a configuration according to a specific embodiment of an improved tub girder constructed in accordance with the present inventions.
Figure 2:
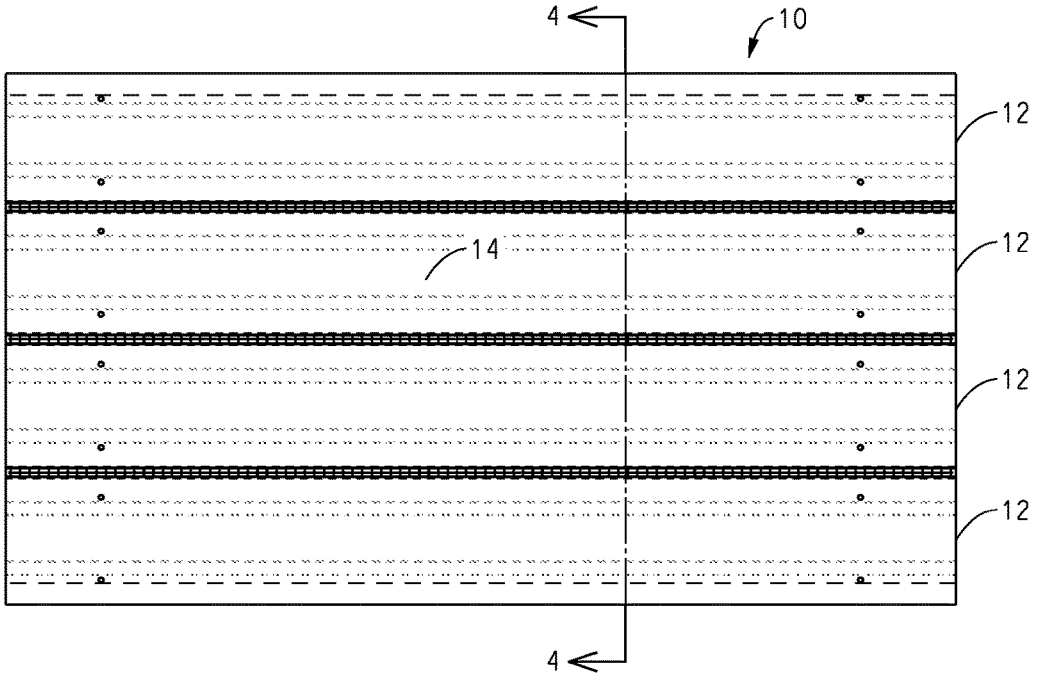
FIG. 2 is a top view of a bridge section formed by a plurality of improved tub girders constructed according to a specific embodiment of the present inventions overlaid by a concrete bridge deck.
Figure 3:
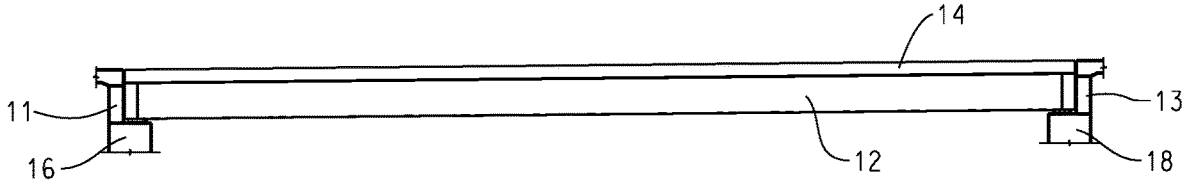
FIG. 3 is a side view of the bridge section shown in FIG. 2 and illustrating an improved tub girder constructed according to a specific embodiment of the present inventions overlaid by a concrete bridge deck.

Referring to the drawings in detail, wherein like numerals denote identical elements throughout the several views, and referring initially to FIG. 1, there is shown a perspective view of a bridge structure 10 constructed using improved tub girders 12 in a configuration according to a specific embodiment of an improved tub girder constructed in accordance with the present inventions, as will be discussed below. With reference to FIG. 2, which is a top view of the bridge structure 10 shown in FIG. 1, it can be seen that the bridge structure 10 is formed by a plurality of improved tub girders 12 constructed according to the present inventions overlaid by a concrete bridge deck 14. Referring to FIG. 3, which is a side view of the bridge structure 10 shown in FIG. 2, a specific embodiment of an improved tub girder 12 constructed in accordance with the present invention is shown supporting the concrete bridge deck 14. It can also be seen in FIG. 3 that opposite ends of the improved tub girder 12 are resting on girder supports 16 and 18. Referring to FIG.

4, which is a cross-sectional view taking along lines 4-4 of FIG. 2, a plurality of specific embodiments of improved tub girders 12 constructed according to the present inventions are shown overlaid by and supporting the concrete bridge deck 14.

Figure 4:
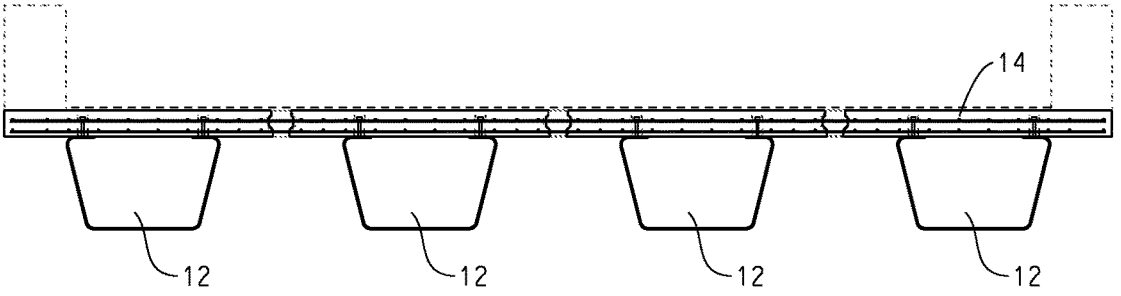
FIG. 4 is a cross-sectional view taking along lines 4-4 on FIG. 2 and showing a plurality of improved tub girders constructed according to specific embodiments of the present inventions and overlaid by a concrete bridge deck.
Figure 5:
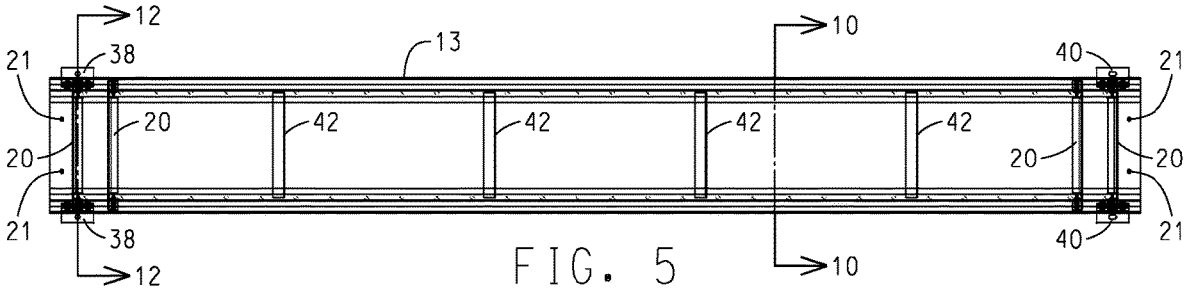
FIG. 5 is a top view of a specific embodiment of an improved tub girder constructed in accordance with the present inventions.
Figure 6:
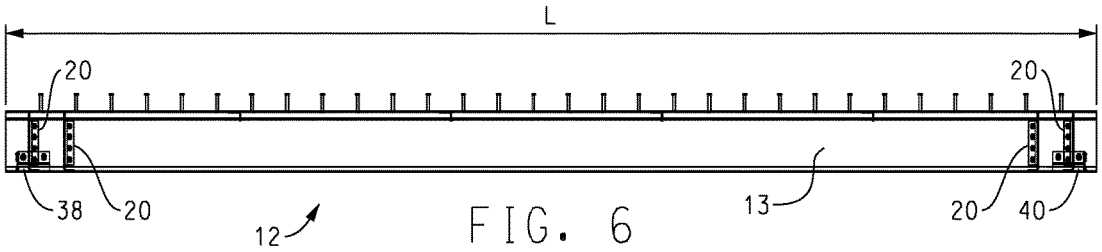
FIG. 6 is a side view of the improved tub girder shown in FIG. 5.
Figure 7:
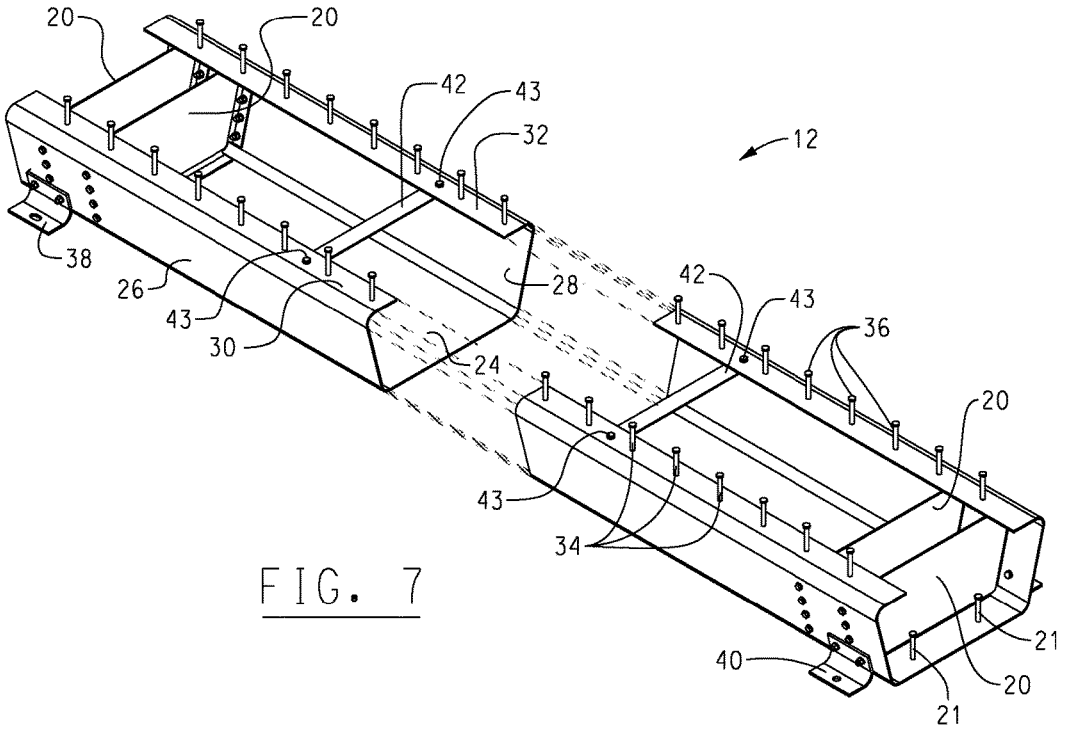
FIG. 7 is an enlarged partially-broken perspective view of the improved tub girder shown in FIGS. 6 and 7.
Figure 8:
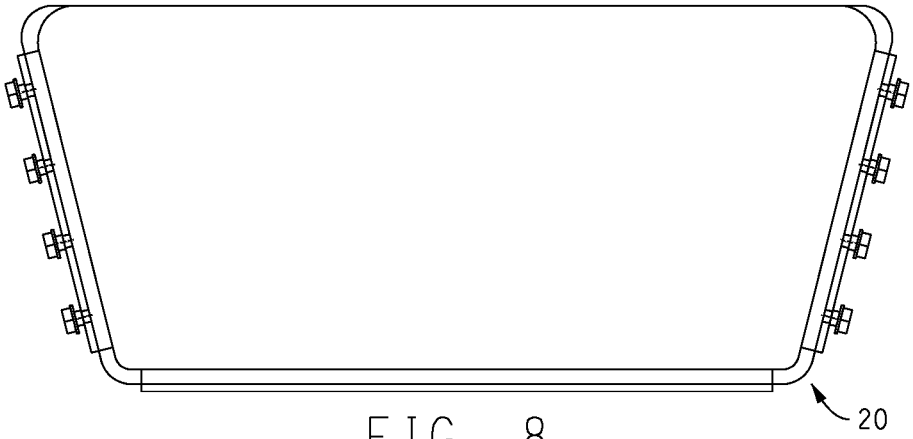
FIG. 8 is an end view of a bent steel plate end diaphragm that in a specific embodiment is connected to the end of the improved tub girder as shown in FIGS. 5-7.
Figure 9:
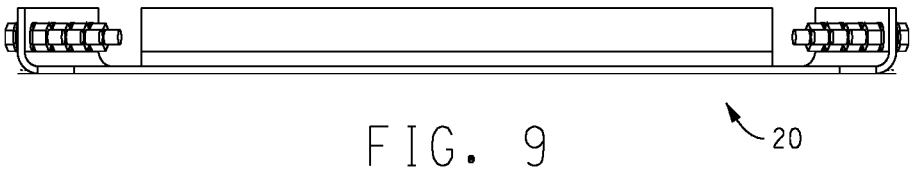
FIG. 9 is a top view of the bent steel plate end diaphragm shown in FIG. 8.

Referring now to FIG. 5, a top view of a specific embodiment of an improved tub girder 12 is shown, such as those shown in FIGS. 2-4. FIG. 6 is a side view of the tub girder 12 shown in FIG. 5. FIG. 7 is an enlarged partially-broken perspective view of the tub girder 12 as shown in FIGS. 5 and 6. As shown in FIG. 7, each end of each improved tub girder 12 may be provided with one or more bent steel plate end diaphragms 20. Referring to FIG. 8, an end view of a specific embodiment of a bent steel plate end diaphragm 20 is shown by itself not connected to a tub girder 12. It can be seen from FIG. 8 that shape of the bent steel plate end diaphragm 20 generally matches the inner cross-sectional profile of the tub girder 12. FIG. 9 is a top view of the bent steel plate end diaphragm 20 shown in FIG. 8.

Figure 10:
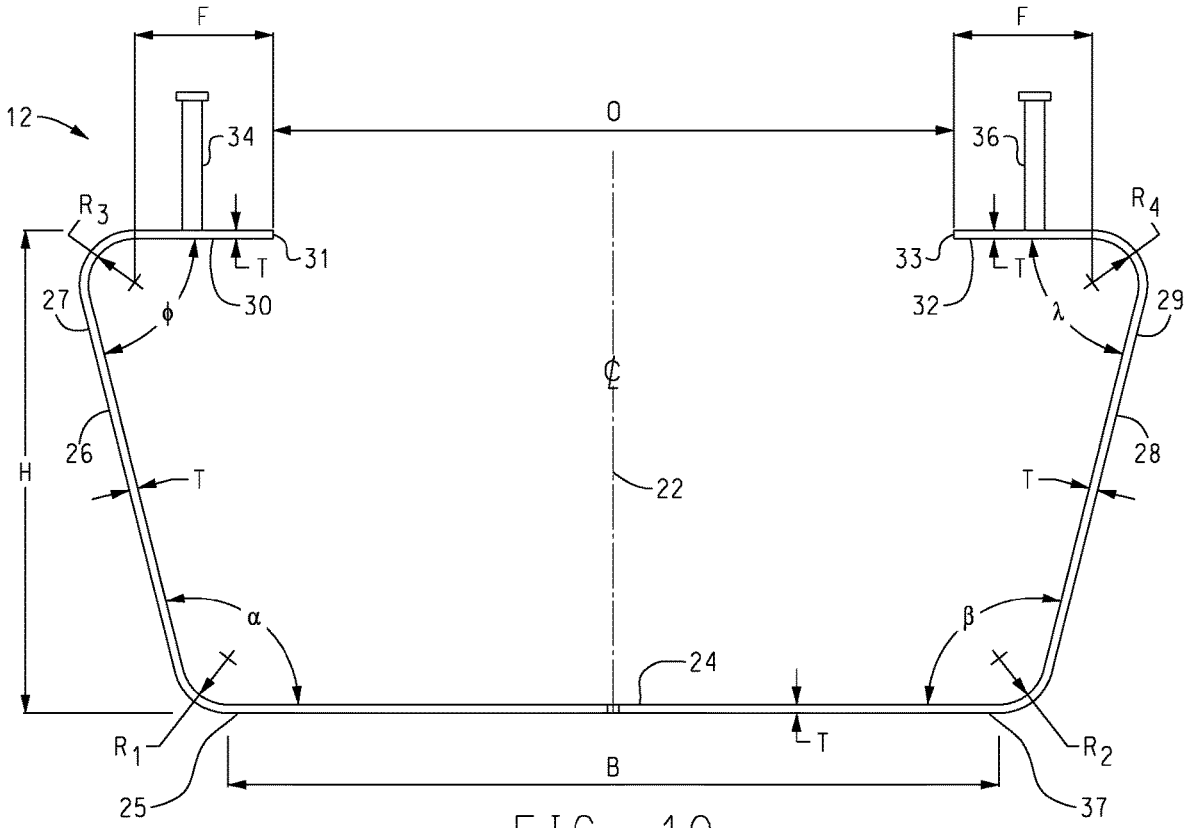
FIG. 10 is a cross-sectional view taken along line 10-10 of FIG. 5 showing the side profile of the specific embodiment of the improved tub girder constructed in accordance with the present inventions as illustrated in FIGS. 5-7.

FIG. 10 is a cross-sectional view taken along lines 10-10 of FIG. 5, and illustrates a cross-sectional profile of a specific embodiment of an improved tub girder 12 that may be constructed in accordance with the present inventions, such as the tub girder 12 shown in FIGS. 5-7. As more fully explained below, the present inventions encompass numerous specific configurations for the cross-sectional profile of an improved tub girder 12. In a specific embodiment, as shown in FIG. 6, an improved tub girder 12 according to the present inventions may include a body member 13 having a length L. Referring now to FIG. 10, in a specific embodiment, the body member 13 may include a base 24 having a central axis 22, an outwardly inclining left support member 26, an outwardly inclining right support member 28, a left flange 30 extending from an upper end 27 of the outwardly inclining left support member 26, and a right flange 32 extending from an upper end 29 of the outwardly inclining right support member 28. In a specific embodiment, the central axis 22 may bisect and be disposed in a generally perpendicular relationship to the base 24. In a specific embodiment, the base 24 may have a base width B.

Figure 11:
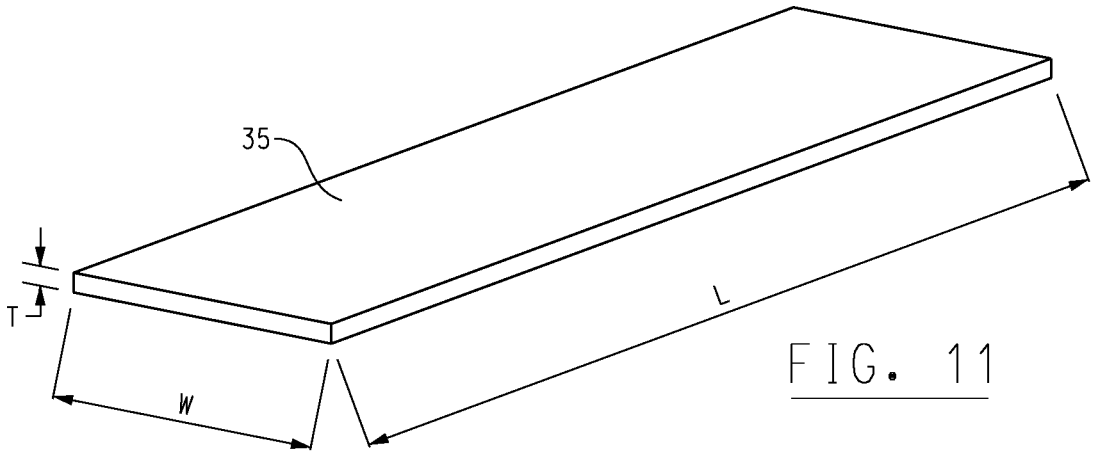
FIG. 11 is a perspective view of a single sheet of flat plate steel that may be used to form improved tub girders constructed in accordance with the present inventions.

In a specific embodiment, the tub girder 12 may be formed from a piece of flat steel or flat plate 35 as shown in FIG. 11 having a width W, a thickness T and a length L. The thickness T is also shown in the specific embodiment of the tub girder 12 as shown for example in FIG. 10. In a specific embodiment, the shape of the tub girder 12 may be formed using a press brake by bending the flat plate 35 at four (4) locations. For each bend (e.g., see the bends corresponding to $R_1$, $R_2$, $R_3$ and $R_4$ in FIG. 10, as discussed below), the bends are formed by applying pressure to the flat plate 35 at the center of the bend and along a line parallel with the length of the plate. In another specific embodiment, the tub girder 12 may be formed from the flat plate 35 using a roll forming process. In another specific embodiment, the tub girder 12 may be formed at a steel mill using a hot roll forming process; in this instance, instead of starting with a finished flat steel plate 35, the tub girder 12 is formed as the steel is being formed. In other words, the steel is initially formed at the steel mill in the shape of the tub girder 12.

In a specific embodiment, the tub girder 12 may be provided with a coating, such as by hot dip galvanizing, aluminized or metalized, for example. A coating may be included to provide for superior corrosion protection of base steel, thereby adding service life to the tub girder steel and limiting the need and/or frequency of inspection.

Referring to FIG. 10, in a specific embodiment, the outwardly inclining left support member 26 may extend upwardly away from a left end 25 of the base 24 at a first angle $\alpha$ and also away from the central axis 22. In a specific embodiment, the outwardly inclining right support member 28 may extend upwardly away from a right end 37 of the base 24 at a second angle $\beta$ and also away from the central axis 22. In a specific embodiment, the left flange 30 may extend inwardly from an upper end 27 of the outwardly inclining left support member 26 toward the central axis 22 at a third angle $\phi$ in relation to the outwardly inclining left support member 26. In a specific embodiment, the right flange 32 may extend inwardly from an upper end 29 of the outwardly inclining right support member 28 toward the central axis 22 at a fourth angle $\lambda$ in relation to the outwardly inclining right support member 28.

In a specific embodiment, the left flange 30 may have an inner end 31 and the right flange 32 may have an inner end 33. In a specific embodiment, the inner end 31 of the left flange 30 may be spaced apart from the inner end 33 of the right flange 32 by an open width having a distance O. In a specific embodiment, the left flange 30 and right flange 32 may be disposed in generally parallel relationship to the base 24. In a specific embodiment, the left and right flanges 30 and 32 may be spaced apart from the base 24 by a height distance H. In a specific embodiment, the left and right flanges 30 and 32 may have a flange width F. In a specific embodiment, the flange width F may be defined as the distance from inner ends 31/33 to the start of the bend radius $R_3/R_4$ (as defined below).

In a specific embodiment, the transition from the base 24 to the outwardly inclining left support member 26 may be defined by a first radius $R_1$. In a specific embodiment, the transition from the base 24 to the outwardly inclining right support member 28 may be defined by a second radius $R_2$. In a specific embodiment, the transition from the outwardly inclining left support member 26 to the left flange 30 may be defined by a third radius $R_3$. In a specific embodiment, the transition from the outwardly inclining right support member 28 to the right flange 32 may be defined by a fourth radius $R_4$. In a specific embodiment, the base width B may be defined as the distance from the center of the first radius $R_1$ to the center of the second radius $R_2$.

As shown in FIGS. 7 and 10, a specific embodiment of an improved tub girder 12 may also include a plurality of left stud members 34 secured to and extending upwardly from the left flange 30, and a plurality of right stud members 36 secured to and extending upwardly from the right flange 32. In a specific embodiment, the left and right stud members 34 and 36 may be disposed in generally perpendicular relationship to the left and right flanges 30 and 32, respectively. In a specific embodiment, the plurality of left and right stud members 34/36 may function to engage the concrete bridge deck 14 and secure it to the tub girders 12, as also illustrated for example in FIG. 4. In a specific embodiment, the improved tub girder 12 may have an overall length L, as shown for example in FIG. 6.

In a specific embodiment, the length L of the tub girder 12 may be in the range of 20 to 100 feet. In a specific embodiment, the angle $\alpha$ may be in the range from 90 to 104 degrees. In a specific embodiment, the angle $\beta$ may be in the range from 90 to 104 degrees. In a specific embodiment, the angle $\phi$ may be in the range from 76 to 90 degrees. In a specific embodiment, the angle $\lambda$ may be in the range from 76 to 90 degrees. In a specific embodiment, the thickness T may be in the range from ⅜ and ½ inches. In a specific embodiment, the width B of the base 24 may be in the range from 28 to 38 inches. An advantage of a wider base 24 is that a wider base allows for greater load carrying capacity of the tub girder 12. In a specific embodiment, the distance H may be in the range from 10 to 35 inches. An advantage of a larger distance H (deeper section) is that it allows for greater load carrying capacity of the tub girder 12. In a specific embodiment, the distance F may be in the range from 4 to 7 inches. In a specific embodiment, the distance O may be preferably be 30 inches. In a specific embodiment, the radius $R_1$ may be in the range from 1½ to 2½ inches. In a specific embodiment, the radius $R_2$ may be in the range from 1½ to 2½ inches. In a specific embodiment, the radius $R_3$ may be in the range from 1½ to 2½ inches. In a specific embodiment, the radius $R_4$ may be in the range from 1½ to 2½ inches.

In a specific embodiment, each of the radii $R_1$, $R_2$, $R_3$, and $R_4$ may be no less than five (5) times the thickness T. In a specific embodiment, the ratio of the open width distance O at the top of the girder 12 to the depth H may vary from 0.85 to 3.0. In a specific embodiment, the ratio of the base width B to the depth H may not be less than 0.8. In a specific embodiment, the ratio of the tub girder length L to the depth H may be no greater than 40. In a specific embodiment, the total flat plate width W prior to bending may be no greater than 144 inches. In a specific embodiment, the ratio of the base width B to thickness T may be no greater than 100. In a specific embodiment, the ratio of the flange width F to thickness T may be no greater than 16.

With reference to FIG. 10, in a specific embodiment of an improved tub girder 12 constructed in accordance with the present inventions, the length L of the tub girder 12 may be about 20 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 38 inches, the distance H may be about 10 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

With reference to FIG. 10, in a specific embodiment of an improved tub girder 12 constructed in accordance with the present inventions, the length L of the tub girder 12 may be about 30 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 37.9 inches, the distance H may be about 12 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

With reference to FIG. 10, in a specific embodiment of an improved tub girder 12 constructed in accordance with the present inventions, the length L of the tub girder 12 may be about 40 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 36.5 inches, the distance H may be about 15 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

With reference to FIG. 10, in a specific embodiment of an improved tub girder 12 constructed in accordance with the present inventions, the length L of the tub girder 12 may be about 50 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 34.9 inches, the distance H may be about 18 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

With reference to FIG. 10, in a specific embodiment of an improved tub girder 12 constructed in accordance with the present inventions, the length L of the tub girder 12 may be about 60 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 33.5 inches, the distance H may be about 21 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

With reference to FIG. 10, in a specific embodiment of an improved tub girder 12 constructed in accordance with the present inventions, the length L of the tub girder 12 may be about 70 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 32 inches, the distance H may be about 25 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

With reference to FIG. 10, in a specific embodiment of an improved tub girder 12 constructed in accordance with the present inventions, the length L of the tub girder 12 may be about 80 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 30.5 inches, the distance H may be about 28 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

With reference to FIG. 10, in a specific embodiment of an improved tub girder 12 constructed in accordance with the present inventions, the length L of the tub girder 12 may be about 90 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 29 inches, the distance H may be about 33 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

With reference to FIG. 10, in a specific embodiment of an improved tub girder 12 constructed in accordance with the present inventions, the length L of the tub girder 12 may be about 100 feet, the angle α may be about 104 degrees, the angle β may be about 104 degrees, the angle ϕ may be about 76 degrees, the angle λ may be about 76 degrees, the thickness T may be about ⅜ inches, the width B of the base 24 may be about 28 inches, the distance H may be about 35 inches, the distance F may be about 6 inches, the distance O may be about 30 inches, the radius $R_1$ may be about 2 inches, the radius $R_2$ may be about 2 inches, the radius $R_3$ may be about 2 inches and the radius $R_4$ may be about 2 inches.

Figure 15:
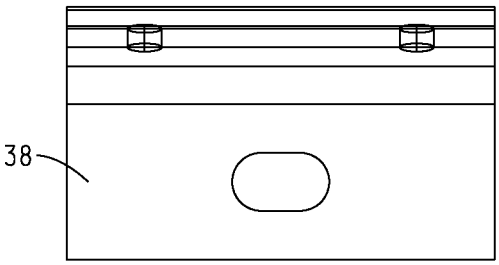
FIG. 15 is a top view of the bent expansion support plate shown in FIGS. 13 and 14.
Figure 13:
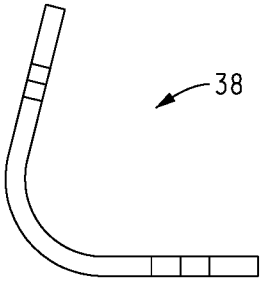
FIG. 13 is a side view of a bent expansion support plate, such as item 40 shown in FIG. 12.
Figure 14:
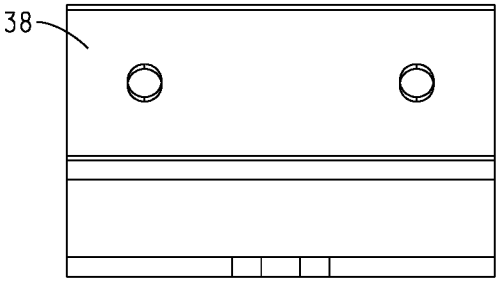
FIG. 14 is a front view of the bent expansion support plate shown in FIG. 13.
Figure 16:
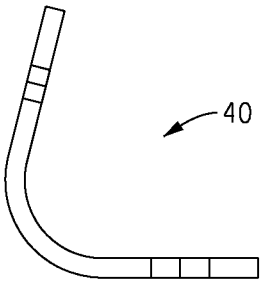
FIG. 16 is a side view of a bent fixed support plate for use in connection with an improved tub girder constructed in accordance with the present inventions.
Figure 17:
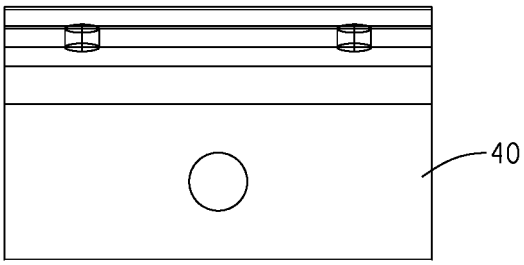
FIG. 17 is a front view of the bent fixed support plate shown in FIG. 16.

Referring to FIG. 7, in a specific embodiment, the tub girder 12 may be secured to girder supports (such as the girder supports 16 and 18 shown in FIG. 3) by a bent expansion support plate 38 at one end of the tub girder 12 and by a bent fixed support plate 40 at the other end of the tub girder 12. In a specific embodiment, the tub girder 12 is fixed at the end with the bent fixed support plate 40, and the other end (with the bent expansion support plate 38) may move and thereby allows for expansion. Bent fixed support plates 40 are shown on opposite sides of the tub girder 12 in FIG. 12, which is a cross-sectional view taken along line 12-12 of FIG. 5. Additional views and details of the bent expansion support plate 38 are shown in FIGS. 13-15. Additional views and details of the bent fixed support plate 40 are shown in FIGS. 16 and 17.

Figure 12:
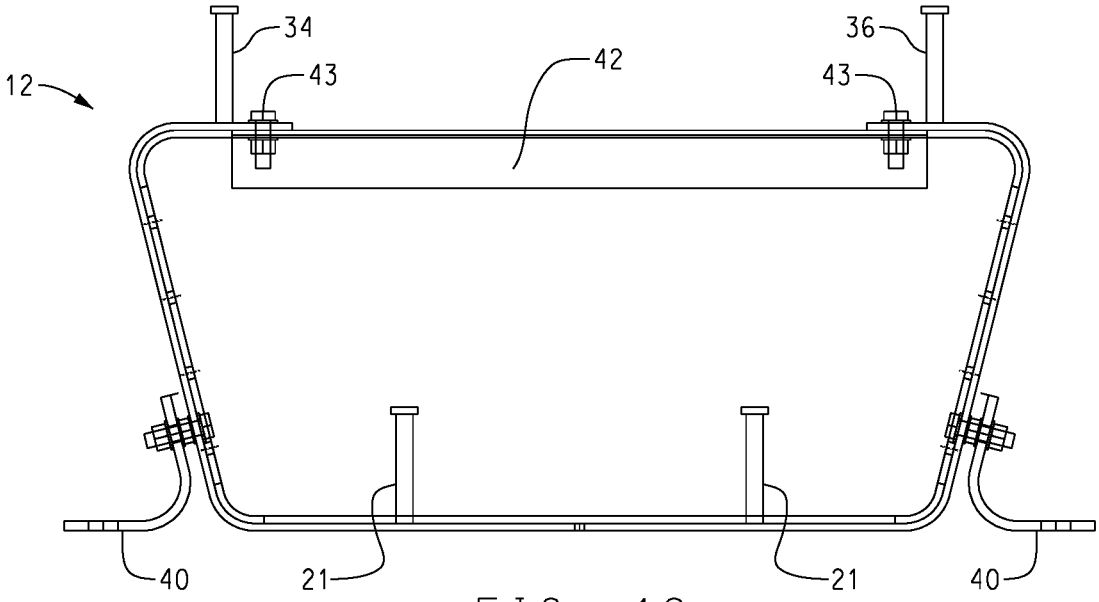
FIG. 12 is a cross-section view taken along lines 12-12 of FIG. 5 showing bent expansion support plates adapted to be attached to and secure an improved tub girder to a support structure, such as shown in FIG. 3.

In a specific embodiment, as shown in FIGS. 5, 7 and 12, the base 24 of the tub girder 12 may be provided with one or more upstanding stud members 21 at each end of the tub girder 12. During installation, the ends of the tub girders 12 are positioned adjacent concrete backwalls, such as concrete backwalls 11 and 13 shown in FIGS. 1 and 3. The backwalls provide additional support to the bridge structure and function as a barrier to prevent backfill dirt from moving from below the roadway to the area beneath the bridge structure. With reference to FIG. 7, it can be understood that when an end of the tub girder 12 is positioned against a concrete backwall, a space is defined by the diaphragm 20 closest to the end of the tub girder 12, the concrete backwall, and the inner surface of the tub girder 12. During the installation processed, concrete is poured into this space, which engages the one or more upstanding stud members 21 when the concrete hardens.

Figure 18:
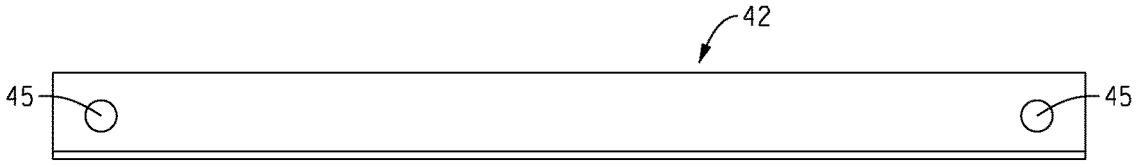
FIG. 18 is a front view of a cross brace support member for use in connection with an improved tub girder constructed in accordance with the present inventions.
Figure 19:
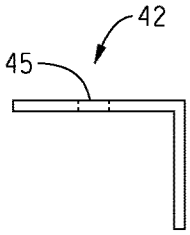
FIG. 19 is a side view showing a specific embodiment of a support member such as shown in FIG. 18 and in the form of a right angle.
Figure 20:
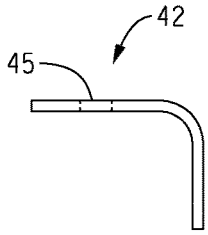
FIG. 20 is a side view showing another specific embodiment of a support member such as shown in FIG. 18 and in the form of a bent angle.

In a specific embodiment, the tub girder 12 may include bracing internal to the tub girder 12 and to the top flanges 30 and 32 to ensure that the tub girder 12 does not distort, buckle or warp due to elastic bending. In a specific embodiment, such bracing may include full depth internal diaphragms placed at the ends and quarter points of the tub girder 12; for example, a specific embodiment of a bent steel plate end diaphragm 20 is discussed above and illustrated in FIGS. 7-9. In a specific embodiment, as shown for example in FIG. 7, the tub girder 12 may include cross braces 42 connected between the left and right flanges 30 and 32 of the tub girder 12. In a specific embodiment, the cross braces 42 may be placed at increments no greater than six (6) feet. In a specific embodiment, as shown in FIGS. 18-20, the cross braces 42 may be an angle (FIG. 19) or bent plate (FIG. 20), and may be bolted to the flanges 30 and 32. In a specific embodiment, the cross braces 42 may be secured to each flange 30/32 through bolts placed in holes 45 drilled in the ends of the braces 42 and in the top flanges 30 and 32 of the press-brake-formed tub girder 12.

Figure 21:
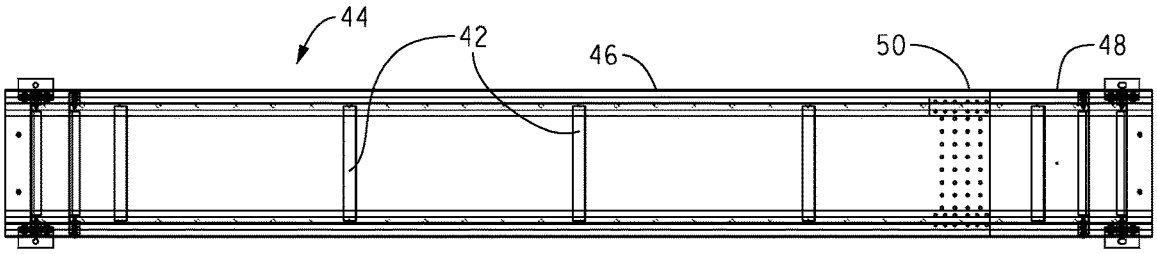
FIG. 21 is a top view of another specific embodiment of an extended length tub girder constructed in accordance with the present inventions and having an extended length achieved through the use of a bolted splice joint.
Figure 22:
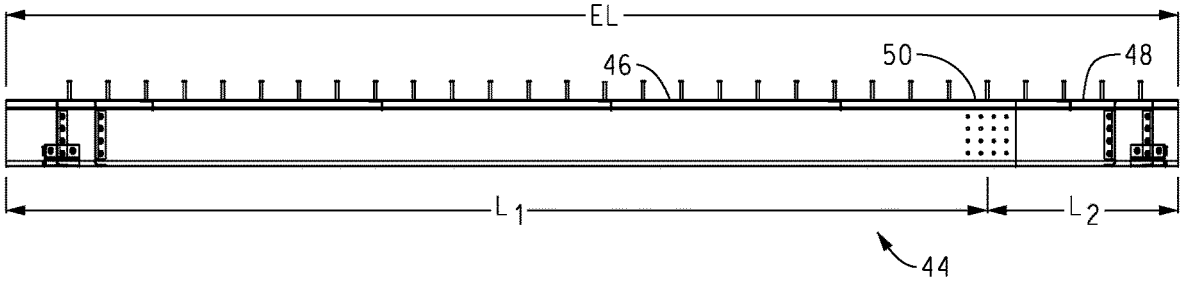
FIG. 22 is a side view of the extended length tub girder shown in FIG. 21.

In a specific embodiment, as shown in FIGS. 21 and 22, an extended length tub girder 44 may be provided in accordance with the present inventions. In a specific embodiment, the extended length tub girder 44 may be formed by connecting a first tub girder 46 to a second tub girder 48. In a specific embodiment, the first tub girder 46 may be longer than the second tub girder 48. In a specific embodiment, the extended length tub girder 44 may have a length EL, the first tub girder 46 may have a length $L_1$ and the second tub girder 48 may have a length $L_2$. In a specific embodiment, the overall length EL of the extended length tub girder 44 may be in the range from 60 to 100 feet. In a specific embodiment, the length $L_1$ of the first tub girder 46 may be in the range from 40 to 55 feet. In a specific embodiment, the length $L_2$ of the second tub girder 48 may be in the range from 5 to 45 feet.

Figure 23:
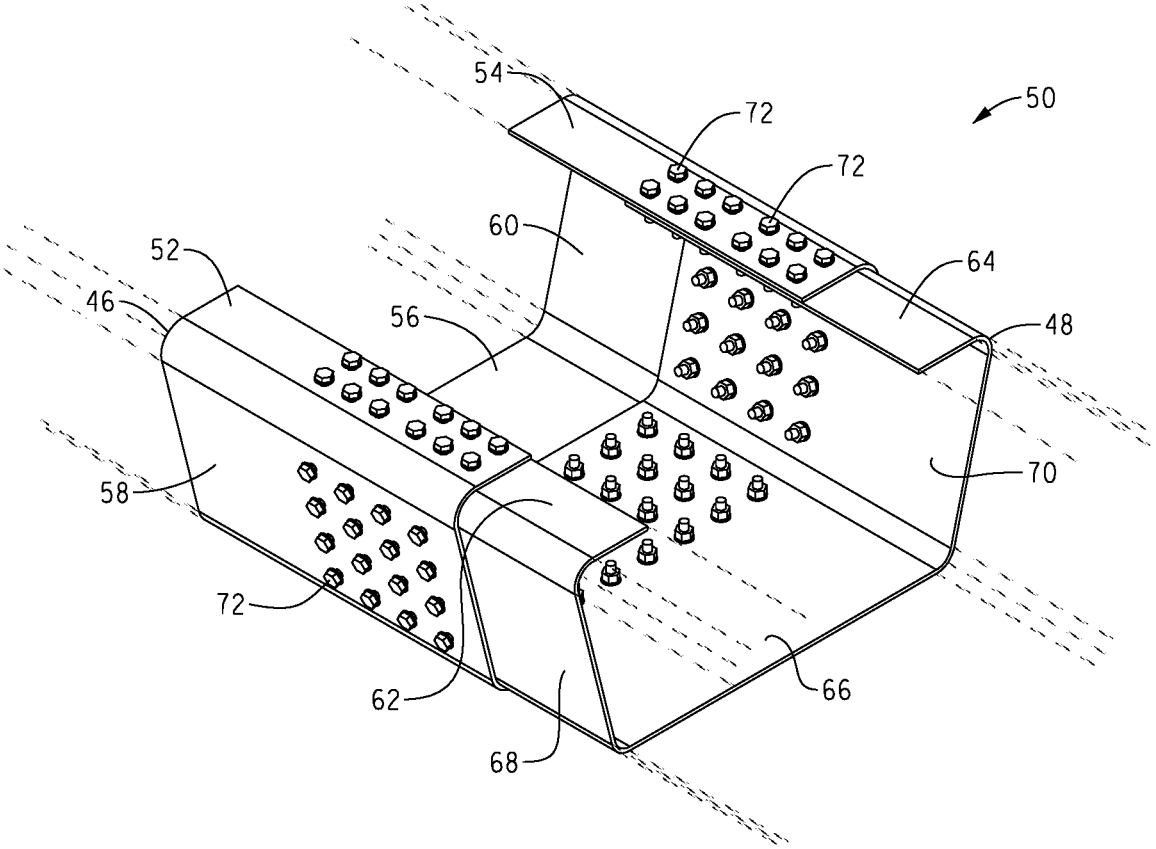
FIG. 23 is a perspective view of the bolted splice joint section of the tub girder shown FIGS. 21 and 22 and illustrates how two improved tub girder sections constructed in accordance with the present inventions may be joined to achieve an extended length improved tub girder.
Figure 24:
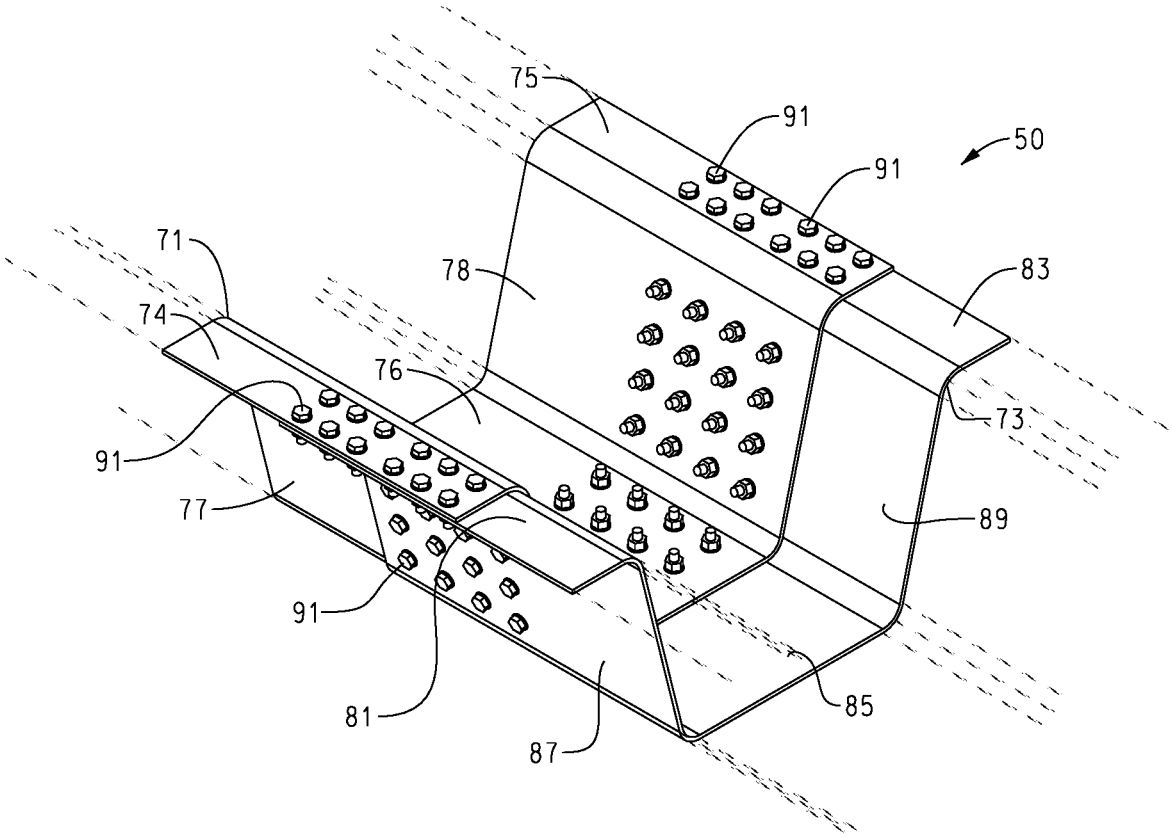
FIG. 24 is another perspective view similar to FIG. 23 except that the tub girders in this view have outwardly extending upper flange members.

In a specific embodiment, the first and second tub girders 46 and 48 may be engaged in a telescoping or overlapping arrangement and then joined and secured together through the use of bolts to create a bolted joint 50, as shown for example in FIGS. 21-24. An enlarged perspective view of a specific embodiment of a bolted joint 50 for a tub girder 12 having inwardly extending flanges 52/54/62/64 is shown in FIG. 23. Another enlarged perspective view of a specific embodiment of a bolted joint for a tub girder 12 having outwardly extending flanges 74/75/81/83 is shown in FIG. 24.

With reference to FIG. 23, it can be seen that, in a specific embodiment, the first tub girder 46 may include a left flange 52, a right flange 54, a base 56, an outwardly inclining left support member 58 and an outwardly inclining left support member 60. Similarly, in a specific embodiment, the second tub girder 48 may include a left flange 62, a right flange 64, a base 66, an outwardly inclining left support member 68 and an outwardly inclining right support member 70. This specific embodiment of the tub girder 12 includes inwardly extending flanges 52/54/62/64. It can also be seen from FIG. 23 that the second tub girder 48 is slightly smaller than, and fits snugly within, the first tub girder 46 in a telescoping or overlapping relationship. The first and second tub girders 46 and 48 are secured together by a plurality of bolts 72, which are positioned on the left flanges 52/62, the right flanges 54/64, the left support members 58/68, the right support members 60/70 and the bases 56/66.

Referring now to FIG. 24, which illustrates the bolted joint 50 for tub girders 71/73 having outwardly extending flanges 74/75/81/83, it can be seen that, in a specific embodiment, the first tub girder 71 may include a left flange 74, a right flange 75, a base 76, an outwardly inclining left support member 77 and an outwardly inclining left support member 78. Similarly, in a specific embodiment, the second tub girder 73 may include a left flange 81, a right flange 83, a base 85, an outwardly inclining left support member 87 and an outwardly inclining right support member 89. It can also be seen from FIG. 24 that the first tub girder 71 is sitting on top of and in mating relationship with the second tub girder 73 in a telescoping or overlapping relationship. The first and second tub girders 71 and 73 are secured together by a plurality of bolts 91, which are positioned on the left flanges 74/81, the right flanges 75/83, the left support members 77/87, the right support members 78/89 and the bases 76/85.

Figure 25:
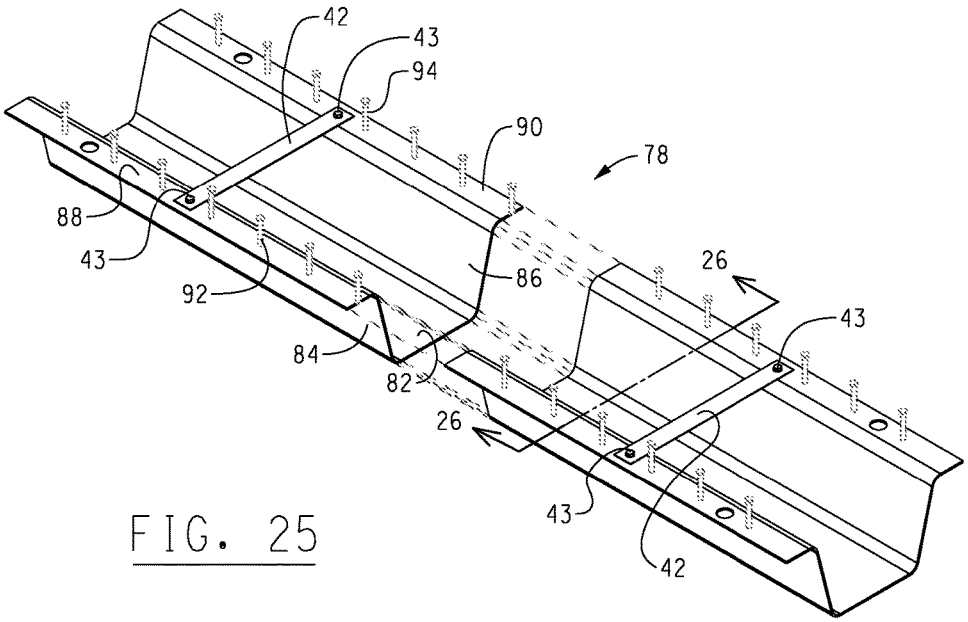
FIG. 25 is a perspective view of another specific embodiment of a tub girder constructed in accordance with the present invention, in which top flanges extend outwardly.
Figure 26:
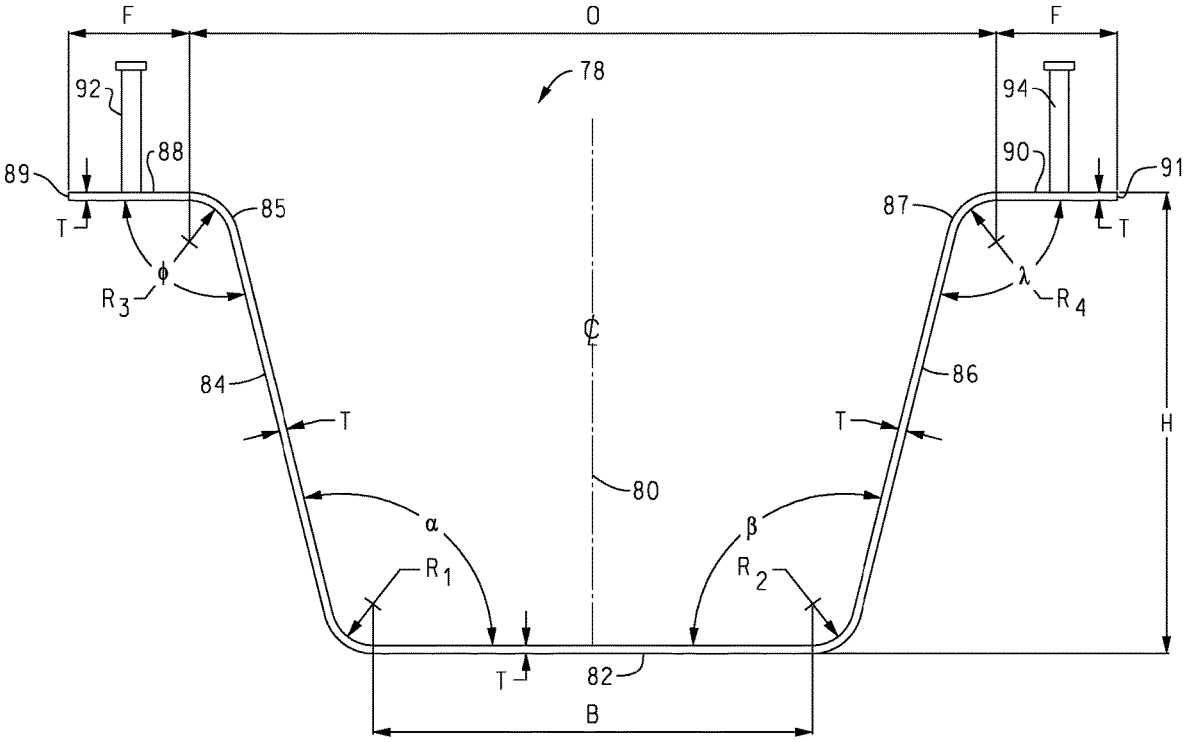
FIG. 26 is a cross-sectional view taken along line 26-26 of FIG. 25.
Figure 27:
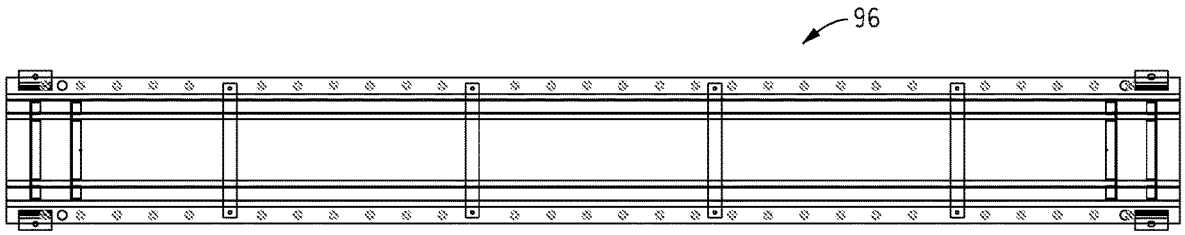
FIG. 27 is a top view of another specific embodiment of a tub girder including camber constructed in accordance with the present inventions.

In another specific embodiment, with reference to FIGS. 25 and 26, a tub girder 78 may be provided in which the upper flanges extend outwardly, as shown above in FIG. 24, instead of inwardly, as shown for example in FIG. 10. Referring to FIG. 26, the tub girder 78 may include a central axis 80, a base 82, an outwardly inclining left support member 84, an outwardly inclining right support member 86, an outwardly extending left flange 88 extending from an upper end 85 of the outwardly inclining left support member 84 and away from the central axis 80, and an outwardly extending right flange 90 extending from an upper end 87 of the outwardly inclining right support member 86 and away from the central axis 80. In a specific embodiment, the central axis 80 may bisect and be disposed in a generally perpendicular relationship to the base 82. In a specific embodiment, the base 82 may have a length B. In a specific embodiment, the tub girder 78 may be formed from a piece of flat steel 35 as shown in FIG. 11 having a width W and a thickness T, such as, for example, by use of a press brake, hot rolled or roll forming, as further discussed above. The thickness T is also shown in the specific embodiment of the tub girder 78 as shown for example in FIG. 26.

Referring to FIG. 26, in a specific embodiment, the outwardly inclining left support member 84 may extend upwardly away from the base 82 at an angle α and also away from the central axis 80. In a specific embodiment, the left flange 88 may extend outwardly from the outwardly inclining left support member 84 away from the central axis 80 at an angle ϕ in relation to the outwardly inclining left support member 84. In a specific embodiment, the outwardly inclining right support member 86 may extend upwardly away from the base 82 at an angle β and also away from the central axis 80. In a specific embodiment, the right flange 90 may extend outwardly from the outwardly inclining right support member 86 away from the central axis 80 at an angle λ in relation to the outwardly inclining right support member 86.

In a specific embodiment, the transition from the base 82 to the outwardly inclining left support member 84 may be defined by a radius $R_1$. In a specific embodiment, the transition from the base 82 to the outwardly inclining right support member 86 may be defined by a radius $R_2$. In a specific embodiment, the transition from the outwardly inclining left support member 84 to the left flange 88 may be defined by a radius $R_3$. In a specific embodiment, the transition from the outwardly inclining right support member 86 to the right flange 90 may be defined by a radius $R_4$. In a specific embodiment, the base length B may be defined as the distance from the center of radius $R_1$ to the center of radius $R_2$. In a specific embodiment, the open width O at the top of the girder 78 may be defined as the distance from the center of the radius $R_3$ to the center of radius $R_4$.

In a specific embodiment, the left flange 88 and right flange 90 may be disposed in generally parallel relationship to the base 82. In a specific embodiment, the left and right flanges 88 and 90 may be spaced apart from the base 82 by a distance H. In a specific embodiment, the left and right flanges 88 and 90 may have a flange width F. In a specific embodiment, the flange width F may be defined as the distance from outer ends 89/91 of the flanges 88/90 to the start of the bend radius $R_3/R_4$.

As shown in FIGS. 25 and 26, the improved tub girder 78 may also include a plurality of left stud members 92 secured to and extending upwardly from the left flange 88, and a plurality of right stud members 94 secured to and extending upwardly from the right flange 90. In a specific embodiment, the left and right stud members 92 and 94 may be disposed in generally perpendicular relationship to the left and right flanges 88 and 90, respectively. In a specific embodiment, the plurality of left and right stud members 92/94 may function to engage the concrete bridge deck 14 and secure it to the tub girders 78, as also illustrated for example in FIG. 4. In a specific embodiment, the improved tub girder 78 may have an overall length L, as shown for example in FIG. 28.

In a specific embodiment, the length L of the tub girder 12 may be in the range of 20 to 100 feet. In a specific embodiment, the angle α may be in the range from 90 to 104 degrees. In a specific embodiment, the angle β may be in the range from 90 to 104 degrees. In a specific embodiment, the angle ϕ may be in the range from 90 to 104 degrees. In a specific embodiment, the angle λ may be in the range from 90 to 104 degrees. In a specific embodiment, the thickness T may be in the range from ⅜ and ½ inches. In a specific embodiment, the width B of the base 82 may be in the range from 18 to 28 inches. In a specific embodiment, the distance H may be in the range from 10 to 35 inches. In a specific embodiment, the distance F may be in the range from 4 to 7 inches. In a specific embodiment, the distance O may be preferably be 40 inches. In a specific embodiment, the radius $R_1$ may be in the range from 1½ to 2½ inches. In a specific embodiment, the radius $R_2$ may be in the range from 1½ to 2½ inches. In a specific embodiment, the radius $R_3$ may be in the range from 1½ to 2½ inches. In a specific embodiment, the radius $R_4$ may be in the range from 1½ to 2½ inches.

In a specific embodiment, each of the radii $R_1$, $R_2$, $R_3$, and $R_4$ may be no less than five (5) times the thickness T. In a specific embodiment, the ratio of the open width distance O at the top of the girder 12 to the depth H may vary from 1.1 to 4.0. In a specific embodiment, the ratio of the base width B to the depth H may not be less than 0.5. In a specific embodiment, the ratio of the tub girder length L to the depth H may be no greater than 40. In a specific embodiment, the total flat plate width W prior to bending may be no greater than 144 inches. In a specific embodiment, the ratio of the base width B to thickness T may be no greater than 75. In a specific embodiment, the ratio of the flange width F to thickness T may be no greater than 16.

With reference to FIG. 26, in a specific embodiment of an improved tub girder 12 constructed in accordance with the present inventions, the length L of the tub girder 12 may be about 20 feet, the angle α may be about 96 degrees, the angle β may be about 96 degrees, the angle ϕ may be about 96 degrees, the angle λ may be about 96 degrees, the thickness T may be about ⅜ inches, the width B of the base 82 may be about 28 inches, the distance H may be about 10 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

With reference to FIG. 26, in a specific embodiment of an improved tub girder 12 constructed in accordance with the present inventions, the length L of the tub girder 12 may be about 30 feet, the angle α may be about 96 degrees, the angle β may be about 96 degrees, the angle ϕ may be about 96 degrees, the angle λ may be about 96 degrees, the thickness T may be about ⅜ inches, the width B of the base 82 may be about 28 inches, the distance H may be about 12 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

With reference to FIG. 26, in a specific embodiment of an improved tub girder 12 constructed in accordance with the present inventions, the length L of the tub girder 12 may be about 40 feet, the angle α may be about 96 degrees, the angle β may be about 96 degrees, the angle ϕ may be about 96 degrees, the angle λ may be about 96 degrees, the thickness T may be about ⅜ inches, the width B of the base 82 may be about 28 inches, the distance H may be about 15 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

With reference to FIG. 26, in a specific embodiment of an improved tub girder 12 constructed in accordance with the present inventions, the length L of the tub girder 12 may be about 50 feet, the angle α may be about 96 degrees, the angle β may be about 96 degrees, the angle ϕ may be about 96 degrees, the angle λ may be about 96 degrees, the thickness T may be about ⅜ inches, the width B of the base 82 may be about 27.5 inches, the distance H may be about 18 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

With reference to FIG. 26, in a specific embodiment of an improved tub girder 12 constructed in accordance with the present inventions, the length L of the tub girder 12 may be about 60 feet, the angle α may be about 96 degrees, the angle β may be about 96 degrees, the angle ϕ may be about 96 degrees, the angle λ may be about 96 degrees, the thickness T may be about ⅜ inches, the width B of the base 82 may be about 27 inches, the distance H may be about 21 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

With reference to FIG. 26, in a specific embodiment of an improved tub girder 12 constructed in accordance with the present inventions, the length L of the tub girder 12 may be about 70 feet, the angle α may be about 96 degrees, the angle β may be about 96 degrees, the angle ϕ may be about 96 degrees, the angle λ may be about 96 degrees, the thickness T may be about ⅜ inches, the width B of the base 82 may be about 26 inches, the distance H may be about 25 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

With reference to FIG. 26, in a specific embodiment of an improved tub girder 12 constructed in accordance with the present inventions, the length L of the tub girder 12 may be about 80 feet, the angle α may be about 96 degrees, the angle β may be about 96 degrees, the angle ϕ may be about 96 degrees, the angle λ may be about 96 degrees, the thickness T may be about ⅜ inches, the width B of the base 82 may be about 25 inches, the distance H may be about 28 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

With reference to FIG. 26, in a specific embodiment of an improved tub girder 12 constructed in accordance with the present inventions, the length L of the tub girder 12 may be about 90 feet, the angle α may be about 103 degrees, the angle β may be about 103 degrees, the angle ϕ may be about 103 degrees, the angle λ may be about 103 degrees, the thickness T may be about ⅜ inches, the width B of the base 82 may be about 18 inches, the distance H may be about 31 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

With reference to FIG. 26, in a specific embodiment of an improved tub girder 12 constructed in accordance with the present inventions, the length L of the tub girder 12 may be about 100 feet, the angle α may be about 104 degrees, the angle β may be about 104 degrees, the angle ϕ may be about 104 degrees, the angle λ may be about 104 degrees, the thickness T may be about ⅜ inches, the width B of the base 82 may be about 18 inches, the distance H may be about 35 inches, the distance F may be about 6 inches, the distance O may be about 39 inches, the radius $R_1$ may be about 2 inches, the radius $R_2$ may be about 2 inches, the radius $R_3$ may be about 2 inches and the radius $R_4$ may be about 2 inches.

Figure 28:
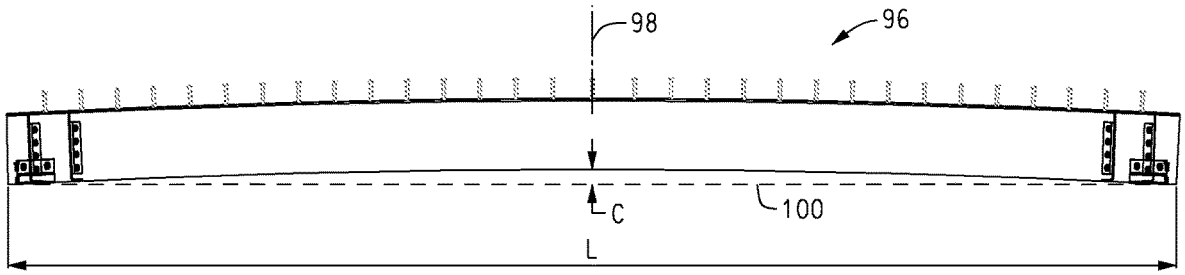
FIG. 28 is a side view of the tub girder shown in FIG. 27 in which the upward arch or camber is illustrated.

Another aspect of the present inventions is that tub girders constructed in accordance with the present inventions, including those with flanges that extend outward and those with flanges that extend inward, may be provided with a slightly arched shape or camber corresponding to a desired camber of the road surface of the concrete bridge deck 14. Deformation (camber) is preferably provided along the length of tub girders according to the present inventions to counteract the deformation (deflection) caused by the future load on the final structure, such as the concrete bridge deck 14. With reference to FIG. 28, a tub girder 96 may have a central axis 98, a length L, and be permanently deformed in the shape of an upward arch or camber. In a specific embodiment, at the central axis 98, the tub girder 96 may be deformed by a distance C from the original shape of the tub girder 96, the lower edge of which is denoted by dashed line 100. In a specific embodiment, for tub girders 96 having a length L in the range of 20 to 100 feet, the distance C may be in the range of 0 to 8 inches.

Figure 29:
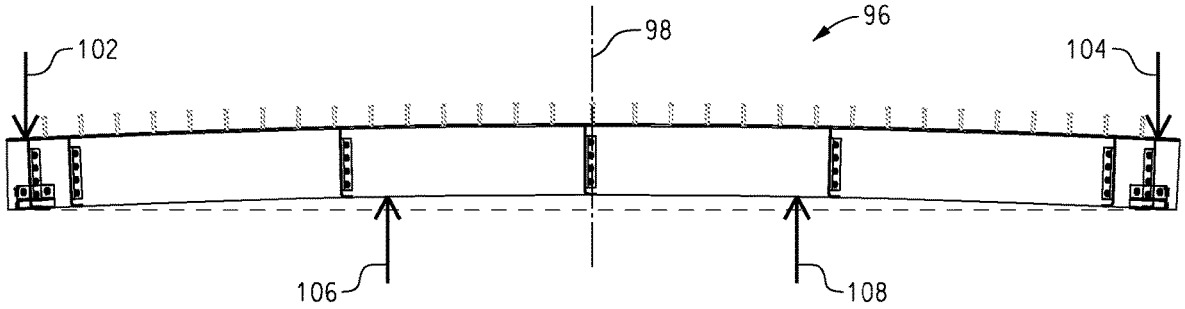
FIG. 29 is a side view similar to FIG. 28 and illustrates a specific embodiment of a process that may be used to induce camber to a tub girder through mechanical deformation.

With reference to FIG. 29, camber may be induced by supporting the tub girder 96 at its ends and indicated by arrows 102 and 104 and then applying pressure preferably at two or more locations, such as indicated by arrows 106 and 108, near to and centered around the central axis 98 of tub girder 96 being cambered. The applied pressure is preferably sufficient to produce an elastic deformation that provides permanent deformation without distorting the shape of the section to the point of damaging the material. In a specific embodiment, because the base 24 (see FIG. 10) is placed into compression during the cambering process, the ratio of the base width B to plate thickness T is preferably less than 100 in order to induce enough permanent deformation by mechanical means without buckling of the base 24 during the cambering process.

In a specific embodiment, with reference to FIGS. 7 and 25, the tub girder 12/78 may be provided with a plurality of holes in the left and right flanges 30/88 and 32/90 to create discrete cross sections with lower moment of inertia and lower section modulus about the left and right flanges. This causes higher stress concentrations in the top flanges 30/88 and 32/90 at the hole locations, which are the furthest tension element (extreme fiber) from the neutral axis. These stress concentrations allow for strain relief and permanent deformation during the cambering process. In a specific embodiment, the plurality of holes may be the holes that receive bolts 43 used to secure the cross braces 42 (through the holes 45 shown in FIG. 18) to the left and right flanges 30/88 and 32/90, as shown for example in FIGS. 7, 12, and 25.

In addition to or as an alternative to inducing camber through mechanical means as discussed above, heat treating may be applied during the cambering process in the top flanges 30/88 and 32/90 to allow for additional stress relief. In a specific embodiment, the temperature of the applied heat preferably does not exceed 1000 degrees. In a specific embodiment, if heat treatment is applied for purposes of stress relief, heating is preferably applied from outer holes at the ends of the tub girder inward towards the middle of the tub girder and preferably heating both flanges 30/88 and 32/90 simultaneously to prevent torsional warping. Heating should preferably not be applied at any hole placed directly in the center (or any 2 holes that straddle the center) of the girder to prevent kinking.

Figure 30:
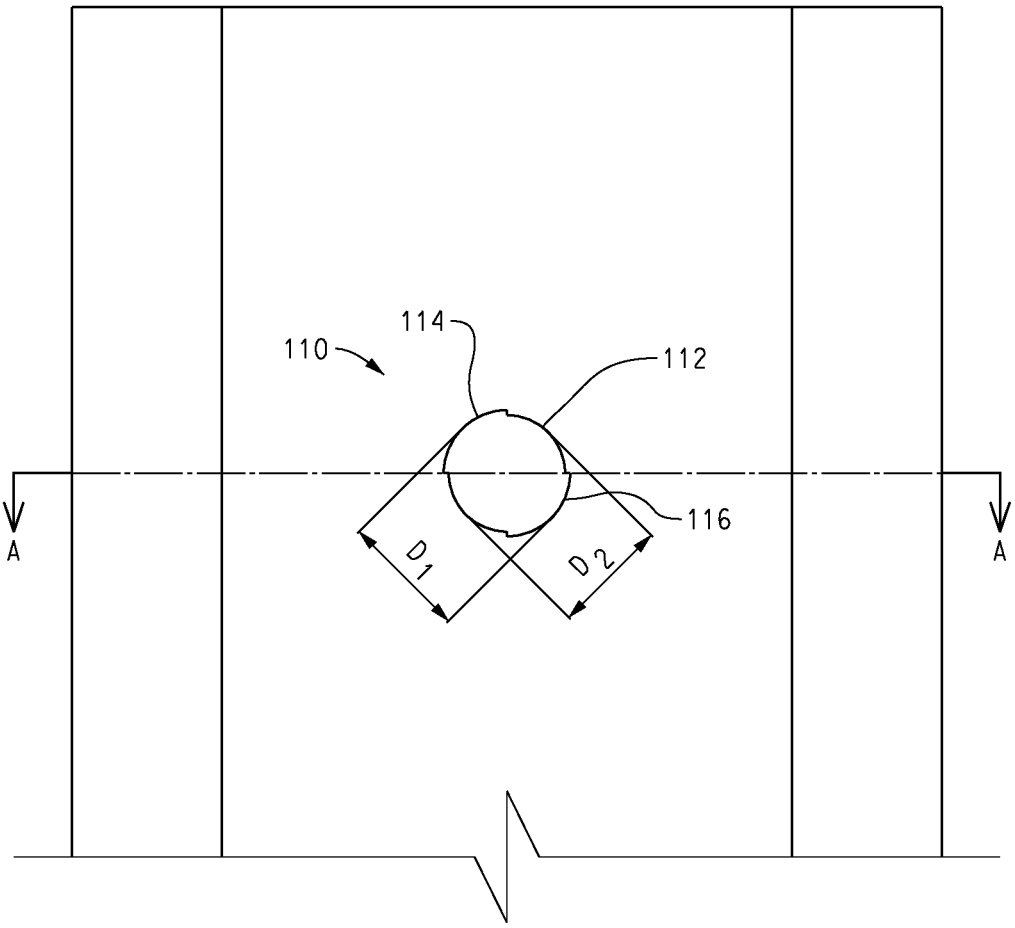
FIG. 30 is a partial bottom plan view of one end of a specific embodiment of an improved tub girder constructed in accordance with the present inventions, and illustrates an inspection port for providing access to the inner cavity of the tub girder after installation.
Figure 31:
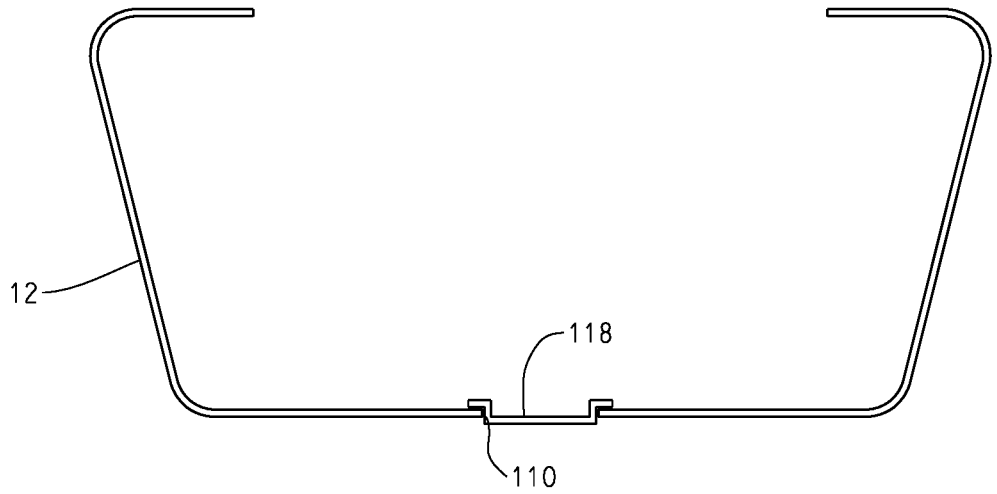
FIG. 31 is a cross-sectional view taken along line A-A of FIG. 30, to illustrate an inspection port in the base of a specific embodiment of a tub girder having inwardly extending flanges in accordance with the present inventions, and with a removable inspection port cover engaged with the inspection port.
Figure 32:
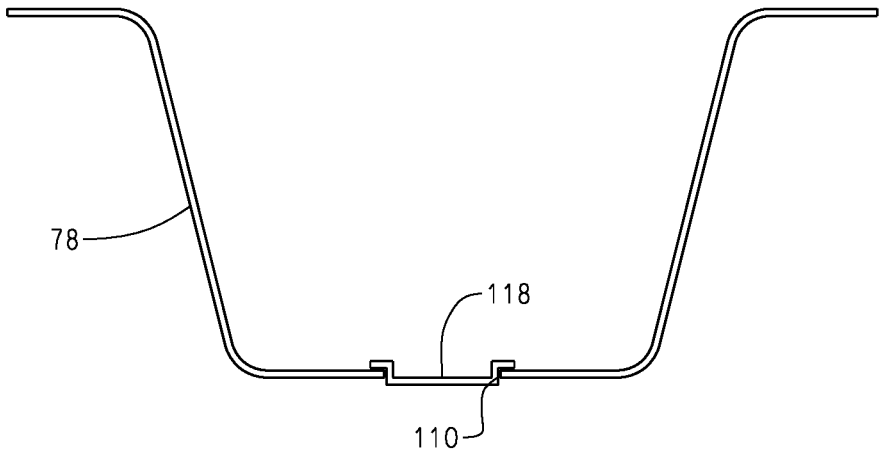
FIG. 32 is a cross-sectional view similar to FIG. 31 and taken along line A-A of FIG. 30, to illustrate an inspection port in the base of a specific embodiment of a tub girder having outwardly extending flanges in accordance with the present inventions, and with a removable inspection port cover engaged with the inspection port.
Figure 33:
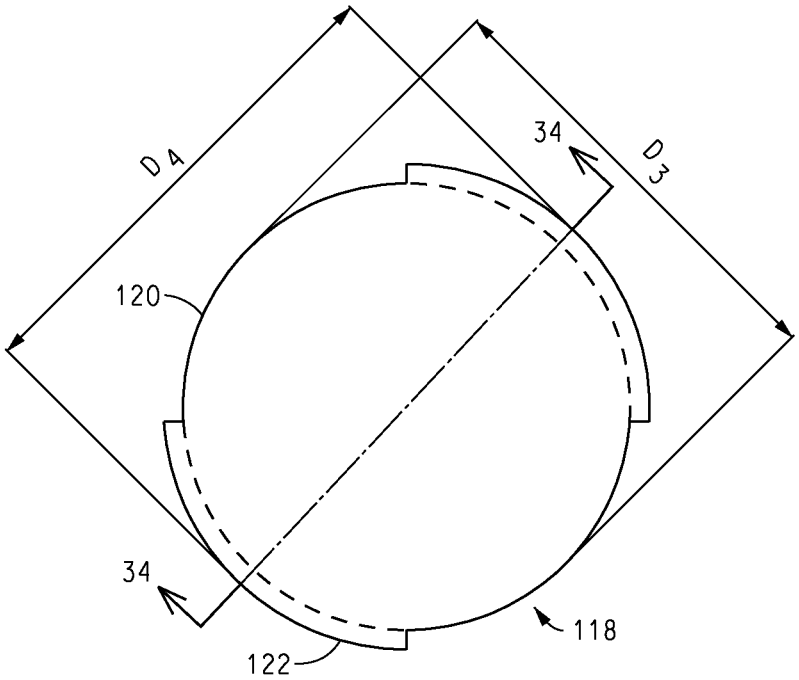
FIG. 33 is a plan view a removable inspection port cover adapted for engagement with an inspection port such as shown in FIGS. 30-32.
Figure 34:
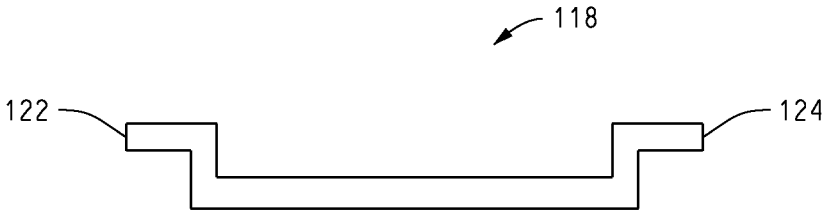
FIG. 34 is a cross-sectional view taken along line 34-34 of FIG. 33.

In another specific embodiment, tub girders constructed in accordance with the present inventions, such as tub girders 12 and 78 for example, may be provided with lower inspection ports to enable access to view and inspect the inner space of the tub girders. For example, as shown in FIG. 30, which is a partial bottom plan view of one end of the tub girder 12, in a specific embodiment, the base 24 may include an inspection port 110 having a primary circular section 112 with opposed outwardly extending semi-circular notches 114 and 116. In a specific embodiment, each inspection port 110 is large enough to allow the passage of inspection equipment (e.g., cameras, electronic thickness gauge, etc.) into the inner cavity of the tub girder 12. For example, in a specific embodiment, the diameter $D_1$ of the primary circular section 112 may be six (6) inches, and the outer distance $D_2$ between the notches 114 and 116 may be six and one half (6½) inches. In a specific embodiment, an inspection port 110 may be positioned approximately two (2) feet from each end of the tub girder 12.

In a specific embodiment, with reference to FIGS. 31-34, each inspection port 110 may be provided with a removable inspection port cover 118, which may function, for example, to prevent small animals from entering the inner cavity of the tub girder. In a specific embodiment, the cover 118 may be loose fitting to allow moisture to escape and allow air flow to help interior condensation to dry. In a specific embodiment, the cover 118 may have a shape that matches the shape of the inspection ports 110. In a specific embodiment, the cover 118 may have a primary circular section 120 with opposed outwardly extending semi-circular tabs 122 and 124. In a specific embodiment, the diameter $D_3$ of the circular section 120 may be five and three-quarters (5¾) inches, and the outer distance $D_4$ between the tabs 122 and 124 may be six and one quarter (6¼) inches. To install the cover 118, the tabs 122/124 are aligned with the notches 114/116 of the inspection port 110, pushed up and then rotated one quarter turn and lowered so that the tabs 122/124 rest on and are supported by the base 24.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims.

The invention claimed is:

1. An improved tub girder having a body member having a girder length, comprising:

a base having a central axis that bisects and is disposed in a generally perpendicular relationship to the base;

an outwardly inclining left support member extending upwardly away from a left end of the base at a first angle and also away from the central axis, a transition from the left end of the base to the outwardly inclining left support member being defined by a first radius, the first angle being in the range from 90 to 104 degrees;

an outwardly inclining right support member extending upwardly away from a right end of the base at a second angle and also away from the central axis, a transition from the right end of the base to the outwardly inclining right support member being defined by a second radius, the second angle being in the range from 90 to 104 degrees;

a left flange extending inwardly toward the central axis from an upper end of the outwardly inclining left support member at a third angle in relation to the outwardly inclining left support member, the left flange being disposed in generally parallel relationship to the base and spaced apart from the base by a height distance, a transition from the upper end of the outwardly inclining left support member to the left flange being defined by a third radius, the left flange having an inner end, the left flange having a left flange width equal to the distance from the inner end of the left flange to a center of the third radius, the third angle being in the range from 76 to 90 degrees;

a right flange extending inwardly toward the central axis from an upper end of the outwardly inclining right support member at a fourth angle in relation to the outwardly inclining right support member, the right flange being disposed in generally parallel relationship to the base and spaced apart from the base by the height distance, a transition from the upper end of the outwardly inclining right support member to the right flange being defined by a fourth radius, the right flange having an inner end, the right flange having a right flange width equal to the distance from the inner end of the right flange to a center of the fourth radius, the fourth angle being in the range from 76 to 90 degrees;

the inner end of the left flange being spaced apart from the inner end of the right flange by an open width distance, a ratio of the open width distance to the height distance being in the range from 0.85 to 3.0;

the base, outwardly inclining left support member, outwardly inclining right support member, left flange and right flange having a common thickness, a ratio of the left flange width to the common thickness being no greater than 16, a ratio of the right flange width to the common thickness being no greater than 16;

each of the first radius, the second radius, the third radius and the fourth radius being at least five times greater than the common thickness; and the base having a base width equal to the distance from a center of the first radius to a center of the second radius, a ratio of the base width to the height distance being at least greater than 0.8, and a ratio of the base width to the common thickness being no greater than 100.

2. The improved tub girder of claim 1, wherein each of the first radius, the second radius, the third radius and the fourth radius is in the range from 1½ to 2½ inches.

3. The improved tub girder of claim 1, wherein the open width distance is approximately thirty inches.

4. The improved tub girder of claim 1, wherein the girder length is in the range from 20 to 100 feet.

5. The improved tub girder of claim 1, wherein the body member is formed from a single rectangular sheet of material through use of at least one of a press brake, hot rolling and roll forming.

6. The improved tub girder of claim 1, wherein the body member is permanently, mechanically deformed to include camber along its girder length.

7. The improved tub girder of claim 1, wherein the body member includes at least one of a galvanized coating, an aluminized coating and a metalized coating.

8. An improved tub girder having a body member having a girder length, comprising:

a base having a central axis that bisects and is disposed in a generally perpendicular relationship to the base;

an outwardly inclining left support member extending upwardly away from a left end of the base at a first angle and also away from the central axis, a transition from the left end of the base to the outwardly inclining left support member being defined by a first radius, the first angle being in the range from 90 to 104 degrees;

an outwardly inclining right support member extending upwardly away from a right end of the base at a second angle and also away from the central axis, a transition from the right end of the base to the outwardly inclining right support member being defined by a second radius, the second angle being in the range from 90 to 104 degrees;

a left flange extending outwardly away from the central axis from an upper end of the outwardly inclining left support member at a third angle in relation to the outwardly inclining left support member, the left flange being disposed in generally parallel relationship to the base and spaced apart from the base by a height distance, a transition from the upper end of the outwardly inclining left support member to the left flange being defined by a third radius, the left flange having an outer end, the left flange having a left flange width equal to the distance from the outer end of the left flange to a center of the third radius, the third angle being in the range from 90 to 104 degrees;

a right flange extending outwardly away from the central axis from an upper end of the outwardly inclining right support member at a fourth angle in relation to the outwardly inclining right support member, the right flange being disposed in generally parallel relationship to the base and spaced apart from the base by the height distance, a transition from the upper end of the outwardly inclining right support member to the right flange being defined by a fourth radius, the right flange having an outer end, the right flange having a right flange width equal to the distance from the outer end of the right flange to a center of the fourth radius, the fourth angle being in the range from 90 to 104 degrees;

the left flange being spaced apart from the right flange by an open width distance defined by the distance from the center of the third radius to the center of the fourth radius, a ratio of the open width distance to the height distance being in the range from 1.1 to 4.0;

the base, outwardly inclining left support member, outwardly inclining right support member, left flange and right flange having a common thickness, a ratio of the left flange width to the common thickness being no greater than 16, a ratio of the right flange width to the common thickness being no greater than 16;

each of the first radius, the second radius, the third radius and the fourth radius being at least five times greater than the common thickness; and the base having a base width equal to the distance from a center of the first radius to a center of the second radius, a ratio of the base width to the height distance being at least greater than 0.5, and a ratio of the base width to the common thickness being no greater than 75.

9. The improved tub girder of claim 8, wherein each of the first radius, the second radius, the third radius and the fourth radius is in the range from 1½ to 2½ inches.

10. The improved tub girder of claim 8, wherein the open width distance is approximately forty inches.

11. The improved tub girder of claim 8, wherein the girder length is in the range from 20 to 100 feet.

12. The improved tub girder of claim 8, wherein the body member is formed from a single rectangular sheet of material through the use of at least one of a press brake, hot rolling and roll forming.

13. The improved tub girder of claim 8, wherein the body member is permanently, mechanically deformed to include camber along its girder length.

14. The improved tub girder of claim 8, wherein the body member includes at least one of a galvanized coating, an aluminized coating and a metalized coating.

15. An improved tub girder having a body member having a girder length, comprising:

a base having a central axis that bisects and is disposed in a generally perpendicular relationship to the base;

an outwardly inclining left support member extending upwardly away from a left end of the base at a first angle and also away from the central axis, a transition from the left end of the base to the outwardly inclining left support member being defined by a first radius, the first angle being in the range from 90 to 104 degrees;

an outwardly inclining right support member extending upwardly away from a right end of the base at a second angle and also away from the central axis, a transition from the right end of the base to the outwardly inclining right support member being defined by a second radius, the second angle being in the range from 90 to 104 degrees;

a left flange extending from an upper end of the outwardly inclining left support member at a third angle in relation to the outwardly inclining left support member, the left flange being disposed in generally parallel relationship to the base and spaced apart from the base by a height distance, a transition from the upper end of the outwardly inclining left support member to the left flange being defined by a third radius, the left flange having an inner end and an outer end, the left flange having a left flange width, the third angle being in the range from 76 to 104 degrees;

a right flange extending from an upper end of the outwardly inclining right support member at a fourth angle in relation to the outwardly inclining right support member, the right flange being disposed in generally parallel relationship to the base and spaced apart from the base by the height distance, a transition from the upper end of the outwardly inclining right support member to the right flange being defined by a fourth radius, the right flange having an inner end and an outer end, the right flange having a right flange width, the fourth angle being in the range from 90 to 104 degrees;

the left flange being spaced apart from the right flange by an open width distance, a ratio of the open width distance to the height distance being in the range from 0.85 to 4.0;

the base, outwardly inclining left support member, outwardly inclining right support member, left flange and right flange having a common thickness, a ratio of the left flange width to the common thickness being no greater than 16, a ratio of the right flange width to the common thickness being no greater than 16;

each of the first radius, the second radius, the third radius and the fourth radius being at least five times greater than the common thickness; and the base having a base width equal to the distance from a center of the first radius to a center of the second radius, a ratio of the base width to the height distance being at least greater than 0.5, and a ratio of the base width to the common thickness being no greater than 100.

16. The improved tub girder of claim 15, wherein each of the left flange and the right flange extends inwardly toward the central axis.

17. The improved tub girder of claim 15, wherein each of the left flange and the right flange extends outwardly away from the central axis.

18. The improved tub girder of claim 15, wherein the body member is formed from a single rectangular sheet of material with at least one of a press brake and a roll form.

19. The improved tub girder of claim 15, wherein the body member is permanently, mechanically deformed to include camber along its girder length.

20. The improved tub girder of claim 15, wherein the body member includes at least one of a galvanized coating, an aluminized coating and a metalized coating.

* * * * *